United States Patent [19]

Dutt

[11] Patent Number: 4,602,718

[45] Date of Patent: Jul. 29, 1986

[54] DUAL-OPERATION TAMPER-EVIDENT BAND FOR CLOSURES

[75] Inventor: Herbert V. Dutt, Sarasota, Fla.

[73] Assignee: Sun Coast Plastics, Inc., Sarasota, Fla.

[21] Appl. No.: 739,597

[22] Filed: May 31, 1985

[51] Int. Cl.[4] ..... B65D 41/48

[52] U.S. Cl. ..... 215/252; 215/253; 220/270; 220/266

[58] Field of Search ..... 215/252, 253; 220/270, 220/276, 266

[56] References Cited

U.S. PATENT DOCUMENTS

| | | | |
|---|---|---|---|
| 3,158,278 | 11/1964 | Knapp . | |
| 3,441,161 | 3/1967 | Van Baarn . | |
| 3,622,028 | 11/1971 | Lohrer . | |
| 3,685,677 | 8/1972 | Westfall . | |
| 3,707,240 | 12/1972 | Wilson . | |
| 3,788,509 | 1/1974 | Keeler . | |
| 3,874,540 | 4/1975 | Hidding | 215/252 |
| 3,901,403 | 8/1975 | Menke | 215/251 |
| 3,924,769 | 9/1975 | Fillmore | 215/253 X |
| 4,181,232 | 1/1980 | Bellamy et al. | 215/253 X |
| 4,278,180 | 7/1981 | Willis | 215/252 |
| 4,299,328 | 11/1981 | Ochs et al. | 215/252 |
| 4,305,517 | 12/1981 | Dennis | 215/256 |
| 4,458,822 | 7/1984 | Ostrowsky | 215/252 |
| 4,479,586 | 10/1984 | Csaszar | 215/252 X |
| 4,485,934 | 12/1984 | Maguire | 215/252 |

*Primary Examiner*—Donald F. Norton

*Attorney, Agent, or Firm*—Jones, Tullar & Cooper

[57] ABSTRACT

A tamper-evident closure, having a lower band attached by connecting ribs to the lower edge of the skirt portion of a cap, is disclosed. The attaching ribs for the lower band extend radially inwardly, and are adapted to engage radially outwardly extending fins on a container adapted to receive the closure, so that rotation of the cap will fracture the connecting ribs to detach the tamper-evident ring from the cap.

The lower band also incorporates along its bottom edge an inwardly extending shoulder which engages the lower edges of the container fins, when the cap is in place. The cap incorporates a thumb tab for lifting the cap off the container. When this is done, the lifting motion will fracture the connecting ribs to detach the tamper-evident ring from the cap. Thus, either rotational or lifting movement of the cap provides visible evidence that the cap has been moved.

15 Claims, 9 Drawing Figures

DUAL-OPERATION TAMPER-EVIDENT BAND FOR CLOSURES

BACKGROUND OF THE INVENTION

The present invention is directed, in general, to tamper-evident closures for containers, and, more particularly, to closures which incorporate a tamper-evident band designed to be detached from the closure when the closure is either rotated on the container or is lifted off the mouth of the container, thereby providing visible evidence of tampering with the container.

A wide variety of container closures, both metal and plastic, have been designed for providing evidence of tampering with the containers on which they are secured, and for providing visible evidence that the container has been opened, or partially opened. Such closures generally comprise an annular body with a closed end adapted to fit over the mouth of the container, and may include a sealing mechanism for engaging the inner, top, or outside edges of the container mouth to seal the container. Some such closures utilize a security strip of some type which may be connected to the cap, and which must be removed before the cap itself can be removed from the container. Such security strips serve the purpose of providing a visible indication of tampering, but they are often difficult to use, and they are not easily or economically made. To overcome this difficulty, closures have been designed with a tamper-evident ring or band secured to the cap, such bands being designed to be broken away from the cap by rotation of the cap in the direction of opening. A large number of such designs have been produced commercially, but they have not always been totally satisfactory, since they are not always reliable, and don't always indicate the existence of, for example, a broken seal for the container, which can occur without completely opening the closure.

Many tamper-evident bands have been designed to have a plurality of vertically extending ribs which attach the band to its cap. Such bands are often designed with a degree of flexibility which allows the cap to be pressed onto the container, with the band flexing to slide over a retaining bead, so that upon removal of the cap by unthreading it, the lifting action of the cap will detach the ring, and leave it on the container. However, the lifting action caused by unthreading the closure can often unseal the container before the tamper-evident band breaks away from the cap, thereby allowing the contents to become contaminated without providing a positive indication of tampering.

Since most tamper-evident bands are designed to operate with a threaded closure, they are not always satisfactory with a lift-off (nonthreaded) cap, because the band may be too flexible, the connection between the cap and the band may be too strong to permit easy lift-off operation, or because the band fails to protect against twisting of the lift-off cap, which may break the seal between the cap and the container without fracturing the band or its connectors. Such rotation can allow contamination of the contents of the container without providing visible evidence of the damage.

Closures having tamper-evident bands which are sufficiently flexible to slide onto a container without fracturing during a capping operation may also be sufficiently flexible to allow a lift-off cap to be carefully removed without fracturing, for example, by lifting the cap by means of a lift-off tab, causing the cap to bend slightly and allowing the flexible band to be slipped over the retaining bead on the container. If the band is made sufficiently strong to prevent this from happening, as by reducing the flexibility of the band and increasing the strength of the connecting ribs which secure the band to the cap, then the closure may be too difficult for some people to open.

SUMMARY OF THE INVENTION

It is an object of the present invention to overcome the disadvantages of prior tamper-evident closure designs by providing a tamper-evident band which can be broken away from its cap either by rotation of the cap or by a lift-off motion produced by lifting of a thumb tab. This dual-operation band thus provides evidence of a broken container seal much more reliably than was possible with prior designs, and allows the container to be opened in either of two ways, thus providing a closure that is easier to use, as well as being safer. This is accomplished, in accordance with the invention, by providing a tamper-evident band attached by means of vertical connecting ribs to the lower edge of the skirt portion of a cap. In a preferred form of the invention, the cap is of the "lift-off" type, having a thumb tab which allows the cap to be pushed upwardly for quick removal from the container. The connecting ribs are frangible, to allow the lower band to break away from the cap when it is removed from the container.

The connecting ribs are spaced around the circumference of the band and extend radially inwardly to engage a plurality of corresponding, circumferentially spaced, radially outwardly extending fins formed on the container. The outwardly extending container fins are engaged by the connecting ribs of the band when the cap is rotated on the container in either direction, and, upon engagement, further rotation of the cap will fracture the connecting ribs to detach the tamper-evident band from the cap. Thus, rotation of the cap provides evidence of tampering and of the consequent possible loss of sealing between the cap and container, with or without actual removal of the cap.

The tamper-evident band also includes at its lower edge an inwardly extending annular shoulder, which snaps over the bottom edges of the radial fins on the container to hold the cap downwardly in place on the mouth of the container. If the cap is lifted upwardly in a direction to remove it from the container, and, thus, in a direction to break any seal between the container and the closure, the fins engaging the annular shoulder on the band will prevent the band from being lifted, so that the band serves to secure the cap in place against accidental opening of the container. A sufficient upward pressure on the cap will fracture the connecting ribs, to allow the container to be opened, and thereby to provide evidence of tampering. If a primary purpose of the band is to secure the cap in place, the connecting ribs may be too strong to permit easy opening of the container, particularly for some people. In this event, a simple twisting motion may be used to fracture the connecting ribs and separate the band, after which the cap can be easily lifted off the container. The band thus serves the dual purpose of securing the cap and providing visible evidence of tampering.

BRIEF DESCRIPTION OF DRAWINGS

The foregoing and additional objects, features, and advantages of the present invention will become apparent to those of skill in the art, from a consideration of the following detailed description of a preferred embodiment thereof, taken with the accompanying drawings, in which.

DESCRIPTION OF PREFERRED EMBODIMENT

Figure 1:
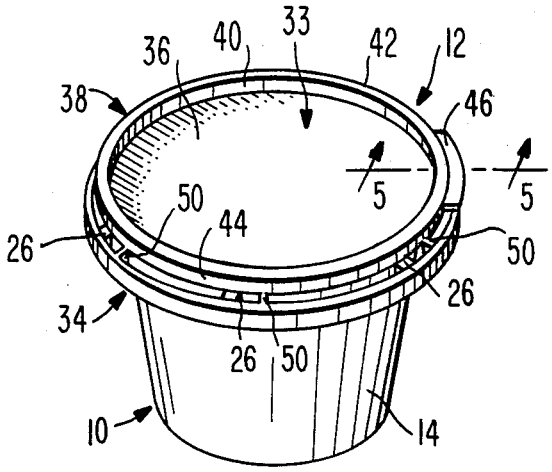
FIG. 1 is a perspective view of the closure of the present invention on a container.
Figure 2:
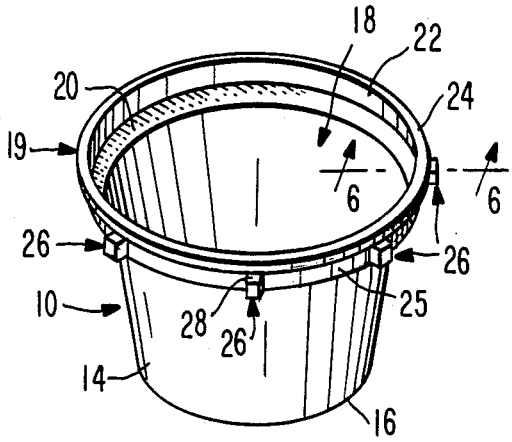
FIG. 2 is a perspective view of the container of FIG. 1, with the closure removed.
Figure 3:
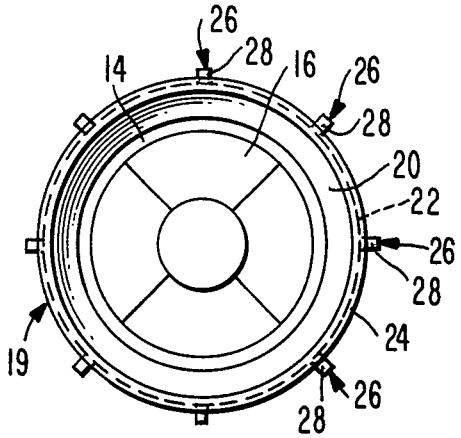
FIG. 3 is a top plan view of the container of FIG. 2.

Turning now to a more detailed consideration of the present invention, there is illustrated in FIG. 1 a container 10 which may be of any arbitrary size or shape, and a closure 12, which is received on the container to seal it. Although the present invention will be described in terms of a particular container and a particular closure shape corresponding to the described container, it will be understood that the invention is not limited to such container and closure shapes. The container 10 is shown in FIGS. 2 and 3 as including a sidewall 14, a bottom 16, and an open mouth 18 defined by a peripheral rim 19, the rim, being shaped to receive and sealingly engage the closure 12. In the illustrated example, the rim 19 includes a horizontal shoulder 20 extending outwardly from the top of sidewall 14, and terminating at its outer edge in an annular, upwardly extending vertical wall 22. At the top of wall 22 is a horizontal, annular, outwardly extending lip 24. The elements 20, 22, and 24 comprise the rim 19, provide a shaped "finish" to the mouth of the container, and are adapted to receive the closure 12. The finish of the container may take other forms, as desired.

Spaced about the periphery of the rim and formed on the exterior surface 25 of vertical wall 22 (see FIG. 6), and located beneath the lip 24, is a series of radially outwardly extending fins 26. These fins are preferably equally spaced about the periphery of the container rim 19, although other spacing arrangements may be provided, with 8 to 16 fins being preferred. The fins 26 are formed unitarily with the wall 22 and lip 24 of the container rim, are sufficiently thick to prevent facturing upon removal of a closure, and are sufficiently long in the radial direction to engage connecting ribs on the closure, to be described.

Figure 6:
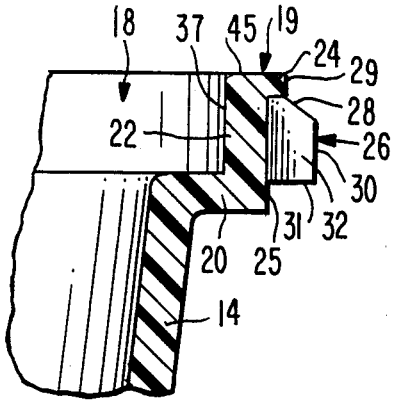
FIG. 6 is a partial sectional view of the container, taken along line 6—6 of FIG. 2.
Figure 7:
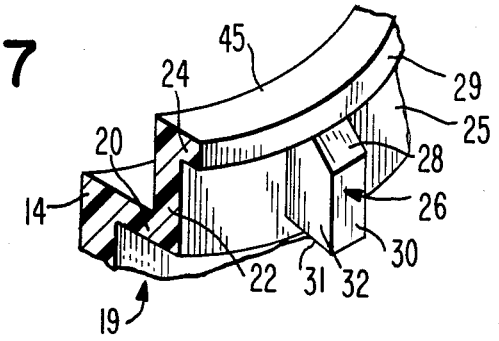
FIG. 7 is a partial perspective view of the container of FIG. 2.

As more clearly illustrated in FIGS. 6 and 7, the top surface 28 of each fin is sloped downwardly from the outer surface 29 of lip 24 to the outer surface 30 of the fin to facilitate a capping operation, while the bottom surface 31 is horizontal to engage a bead on a tamper-evident band, to be described, to thereby prevent removal of the band once the closure is in place. The sides 32 of the fins are adapted to engage connecting ribs on the closure 12, as will be described.

Figure 4:
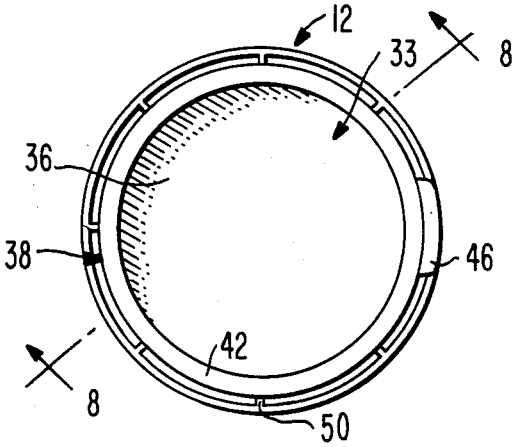
FIG. 4 is a top plan view of the closure of FIG. 1.
Figure 5:
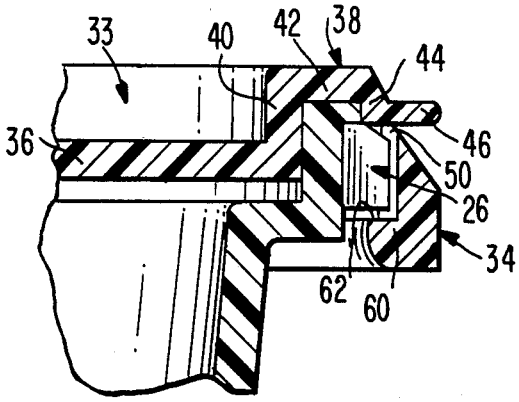
FIG. 5 is a partial sectional view of the closure and container, taken along line 5—5 of FIG. 1.

The closure 12, illustrated in FIGS. 1, 4, 5, 8, and 9, includes a removable cap portion 33, and a depending, tamper-evident band 34 which is secured to the perimeter of the cap portion 33. Cap portion 33 includes a top wall 36, which fits within the mouth 18 of the container 10, extending completely across the diameter of the mouth portion to engage the interior surface 37 of the vertical wall 22 of rim 19 to close the container 10. The cap 33 includes a peripheral sealing portion 38 which is shaped to engage the upper rim portion 19 of container 10, so as to secure the cap on the container, and to seal the container. The rim portion 38 includes an annular vertical wall 40 formed at the periphery of upper wall 36, a horizontal, outwardly extending wall portion 42 formed at the upper edge of wall 40, and a depending annular skirt portion 44 formed at the outer periphery of wall 42. Walls 40 and 42, together with skirt 44, form the rim portion 38 and engage the inner rim surface 37, the upper rim surface 45, and the outer lip surface 29 of the rim 19 for the container 10, as illustrated in FIG. 5.

As shown, the closure 12 is not threaded, but snaps onto the container rim, providing a close-tolerance fit, so that the three engaging surfaces 37, 45, and 29 of the container and the corresponding surfaces of walls 40 and 42 and skirt 44 of the closure provide a seal for the interior of the container. The closure cap portion 33 is removed from the container by pressing up on the skirt portion 44 to disengage the skirt 44 from the outer rim portion of the container defined by lip 24, and bending the cap, and effectively "peeling" the cap off the container. To facilitate removal of the cap portion 33, a thumb tab 46 is provided on the outer edge of the skirt 44, as may be seen in FIGS. 1, 4, and 5.

Figure 8:
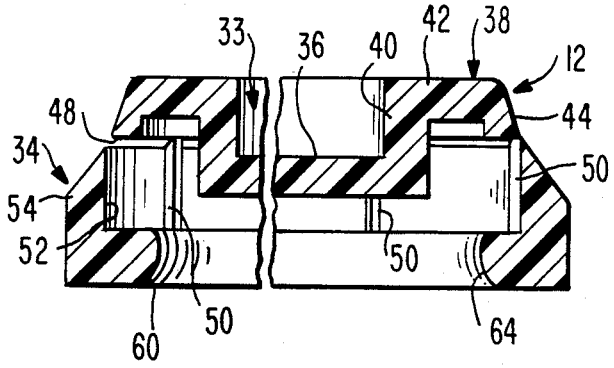
FIG. 8 is a cross-sectional view of the closure taken along line 8—8 of FIG. 4.
Figure 9:
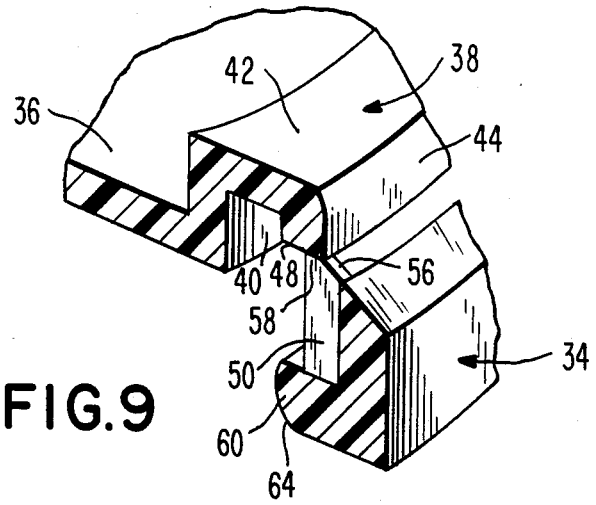
FIG. 9 is a partial perspective view of the closure of FIG. 4.

As most clearly illustrated in FIGS. 8 and 9, the closure 12 incorporates a tamper-evident band 34 which depends from the lower surface 48 of skirt portion 44, the band 34 being fastened to the skirt portion by means of a series of radially inwardly extending connecting ribs 50. These ribs are formed on the inner surface 52 of a vertical, annular wall 54 which forms the main body portion of tamper-evident ring 34, and are preferably integral therewith. The connecting ribs are tapered, as shown at 56 in FIG. 9, to provide a relatively small area of connection 58 to skirt 44. The area of connection 58 is selected to provide sufficient strength to hold the closure 12 in place on the mouth of the container during normal handling, while at the same time being sufficiently small as to be easily breakable upon exertion of an upward force on the thumb tab 46, so that the cap 33 can be torn away from the tamper-evident band 34 for removal from the container. As illustrated in FIGS. 1 and 4, in the preferred form of the invention, at least eight connecting ribs 50 are spaced equidistantly around the periphery of skirt 44 to firmly secure the tamper-evident band 34 to the cap 33, while at the same time being sufficiently frangible to permit the cap 33 to be lifted off of the container 10 with a reasonable amount of upward force on the thumb tab 46.

Band 34 is held in place on the container 10 by means of an annular, inwardly extending bead 60 formed at the bottom of the wall 54 of depending band 34. The bead 60 has a flat upper surface 62, which is adapted to engage the bottom surface 31 of each of the radial fins 26 to prevent removal of the tamper band once the closure is in place on the container. To facilitate placement of the closure on the container, the bottom surface 64 of bead 60 is rounded, as illustrated in FIGS. 5, 8, and 9, so that when the rounded surface 64 engages the sloped top surface 28 of the fins 26 during capping operations, the band 34 will flex outwardly and snap over the fins. The flat top surface 62 then lies under the corresponding horizontal surface 30 on fin 26, to prevent the tamper-evident band from sliding upwardly past the fins 26, thereby holding the closure 12 in place on the container 10 until the connecting ribs 50 are broken away from the skirt 44. When this occurs, the cap 33 can be removed from the closure with the tamper-evident band being left behind.

From the foregoing, it will be evident that when the closure is placed on the container, the sealing edge 38 of cap 33 engages the upper rim 19 of the container, so that the top wall 36 of the cap closes the mouth 18 of the container. During a capping operation, wherein the closure is pressed downwardly onto the top of the container, the tamper-evident band 34 flexes outwardly, and slides over the radially outwardly extending fins 26 on the container, the band snapping over the fins and returning to its original configuration as the cap 33 firmly engages the rim 19 of the container. As indicated in FIG. 5, when the closure is in place, the outer surfaces 29 of the ribs 26 are in close proximity to the inner surface 52 of the tamper-evident band 34. The fins 26 extend between connecting ribs 50 around the circumference of the container, as illustrated in FIGS. 1 and 5. Engagement of the top surface 62 of the bead 60 on the tamper-evident band with the bottom surfaces 30 of the fins 26 serves to hold the closure 12 in place on the container, and maintains the seal between the cap and the rim of the container, in the absence of forces which would fracture the ribs 50. Thus, the cap is retained in place under normal circumstances.

If it is desired to open the container, the cap can be removed simply by lifting upwardly on the thumb tab 46 with sufficient force to break the connecting ribs 50. This tears the cap away from the tamper-evident band 34, to allow the container to be opened, while providing positive, visible evidence of that opening. The engagement of the bead 60 with the ribs 26 prevents the tamper-evident band 34 from being pulled upwardly and off the container.

To facilitate opening of the container, the closure can be rotated in either direction on the container, causing the fins 26 to produce a shearing action on the ribs 50, breaking the ribs and disconnecting the cap 33 from the tamper-evident band. Thereafter, the cap can be lifted from the mouth of the container by means of thumb tab 46. Although in the preferred form, the fins 26 and the connecting ribs 50 are equidistantly spaced around the circumferences of the container and the closure, respectively, it may be desirable to stagger the spacing of either the ribs or the fins, so that upon twisitng of the closure, the ribs are sheared sequentially, thereby reducing the force required to open the container.

Thus, there has been described a new and improved closure which incorporates a tamper-evident band, the closure responding either to a direct liftoff of the closure cap portion, or to a rotation of the cap without lifting, to break away the tamper-evident ring. This new structure provides tamper-evident protection for unthreaded closure caps, providing visible evidence of either lifting or twisting of the cap, while at the same time securing the cap against accidental opening. Although the invention has been described in terms of a specific form of the closure finish and the corresponding cap structure, it will be understood that numerous variations and modifications can be made without departing from the true spirit and scope of the invention, as set forth in the following claims.

What is claimed is:

1. A dual operation, tamper-evident, unitary closure for an unthreaded container, comprising:

a container having an unthreaded upper rim defining a container mouth;

a plurality of fins formed on the outer circumferential surface of said container upper rim;

a lift-off closure cap having an upper wall and an unthreaded circumferential sealing edge, said sealing edge being shaped to engage said container upper rim to close and seal said container;

a skirt formed as a part of said sealing edge, said skirt extending over the outer circumferential surface of said container upper rim above said fins when said closure cap engages said container upper rim;

an annular tamper-evident band depending from said skirt, said band including a band-securing bead;

a plurality of frangible connecting ribs integral with said band and said skirt attaching said band to the lower peripheral edge of said skirt, said band extending around said container upper rim and around said fins, and said band-securing bead extending beneath said fins when said cap engages said container upper rim, said fins being located to break said connecting ribs upon rotation of said closure cap on said container upper rim, said connecting ribs being further breakable by a cap lift-off force, whereby said band provides evidence of tampering upon either lifting of said closure cap or rotation of said closure cap in either direction after said closure cap has been mounted on said container.

2. The closure of claim 1, wherein said fins extend radially outwardly from, and are spaced around, said outer circumferential surface of said container upper rim.

3. The closure of claim 2, further including a thumb tab on the sealing edge of said cap for applying lift-off pressure to said cap.

4. The closure of claim 2, wherein said connecting ribs extend radially inwardly from said tamper-evident band a distance sufficient to engage said fins upon rotation of said cap, said ribs being spaced around the periphery of said skirt and located between said fins.

5. The closure of claim 4, wherein said fins are equidistantly spaced from each other around said container upper rim.

6. The closure of claim 5, wherein said connecting ribs are equidistantly spaced from each other around said skirt.

7. The closure of claim 6, wherein the outer diameter of said skirt is less than the inner diameter of said tamper-evident band, said connecting ribs extending inwardly and upwardly from said band to said skirt.

8. The closure of claim 7, wherein said each of said fins has a flat bottom surface for engaging a corresponding flat upper surface on said bead for preventing removal of said cap from said container without breaking one or more of said connecting ribs.

9. A tamper-evident closure and container, comprising:

a container having a rim adapted to receive a removable closure;

at least one outwardly extending fin on the outer periphery of said rim;

a closure for said container, said closure including:

(a) a lift-off cap having a top wall and a peripheral sealing edge sealingly engaging said rim to close said container;

(b) a tamper-evident band connected to said sealing edge and depending therefrom, said band surrounding the outer periphery of said rim and said outwardly extending fins and adapted to engage the lower edges of said fins upon removal of said cap from said container;

(c) a plurality of frangible connector ribs connecting said band to said sealing edge, said ribs extending inwardly from said band toward said rim and being adapted to engage said fins upon rotation of said closure with respect to said container;

whereby lifting of said cap to open said container or rotation of said closure with respect to said container breaks one or more of said plurality of connecting ribs to provide visible evidence of tampering.

10. The combination of claim 9, wherein said container and closure are nonthreaded.

11. The combination of claim 9, wherein said sealing edge of said cap includes an annular skirt portion surrounding said rim above said fins, said connnector ribs being connected to the lower periphery of said skirt portion.

12. The combination of claim 11, wherein said cap, band, and connecting ribs comprise a single, unitary molded closure.

13. The combination of claim 11, wherein said band includes an annular wall and an inwardly extending bead on the inner surface of said wall, said bead being adapted to engage the bottom edges of said fins.

14. The combination of claim 13, wherein said rim includes a plurality of fins spaced circumferentially around said rim and extending radially outwardly, said fins being spaced so as to extend between said connecting ribs so as to engage said ribs upon rotation of said closure in either direction.

15. The combination of claim 14, said closure further including a thumb tab for lifting said cap for removal thereof to open said container.

* * * * *